US005959226A

United States Patent [19]

Wygent

[11] Patent Number: 5,959,226

[45] Date of Patent: Sep. 28, 1999

[54] BAGPIPE REED

[76] Inventor: Mark A. Wygent, 46 Saddler Dr., Christiana, Pa. 17509-9703

[21] Appl. No.: 09/158,558

[22] Filed: Sep. 22, 1998

[51] Int. Cl.[6] ..... G10D 7/00

[52] U.S. Cl. ..... 84/380 B

[58] Field of Search ..... 84/380 B, 386, 84/350, 383 A, 378, 363, 364, 375

[56] References Cited

U.S. PATENT DOCUMENTS

| | | | |
|---|---|---|---|
| 1,821,655 | 5/1931 | Loomis | 84/364 |
| 1,837,227 | 5/1931 | Loomis | 84/364 |
| 2,098,457 | 9/1937 | Loomis | 84/383 A |
| 2,233,507 | 3/1941 | Adamson . | |
| 2,485,021 | 5/1949 | Strupe | 84/364 |
| 2,488,838 | 11/1949 | Tierce . | |
| 2,598,268 | 5/1952 | Kendrick . | |
| 2,608,796 | 9/1952 | Bicocchi . | |
| 2,729,025 | 1/1956 | Jones . | |
| 3,406,479 | 10/1968 | Faulk . | |
| 4,258,605 | 3/1981 | Lorenzini | 84/386 |
| 5,249,499 | 10/1993 | Goldstein et al. | 84/382 |

*Primary Examiner*—William M. Shoop, Jr.
*Assistant Examiner*—Kim Lockett
*Attorney, Agent, or Firm*—Jacobson, Price, Holman & Stern, PLLC

[57] ABSTRACT

One particular design for providing a substitute to a cane reed incorporates a wood-based, polymer body (the tube), two thin plastic tongues, regulated by a short length of synthetic tubing (the bridle). A brass or plastic tube is screwed or pressed in one end to form the "seat" of the reed, or that portion which is pressed into the bagpipe itself. An opposite end of the tubular body includes a tuning pin to change a pitch of the reed. The bagpipe reed is fashioned from a hollow tube as a body, threaded or tapered at both ends to provide for the use of a threaded or tapered plug (tuning pin) at either end, employed to adjust airflow and pitch. The tuning pin is a socket headed cap screw having external threads at one end and an enlarged, knurled head at the opposite end. The head includes a hexagonal shaped opening for rotation of the tuning pin into and out of the tubular body by an allen wrench. The opposite end of the tubular body includes a threaded and tapered reed seat or moveable insertion base for the reed. The reed seat may be externally threaded at one end and include wrapped waxed threads in a tapered, conical configuration at the opposite end. The reed seat is moulded to include a plurality of ridges to assist in gripping waxed thread wrapped around the reed seat.

20 Claims, 5 Drawing Sheets

BAGPIPE REED

FIELD OF THE INVENTION

The present invention relates to the field of synthetic bagpipe drone reeds having two tongues and being reversible so as to change the direction of the tongues.

BACKGROUND OF THE INVENTION

The bagpipe is an instrument whose development and use spans, in many forms, perhaps 2,000 years. The bagpipe has been played by the people of many cultures, throughout much of recorded history.

Reeds for this woodwind instrument have, until recently, been fashioned from natural material, such as cane (bamboo), occurring in many species and varieties throughout the world. This readily available material produces a warm, harmonically pleasing sound, but is subject to deterioration over relatively short periods of time due to the harsh humid playing environment afforded by life within the bag of a mouth or bellows-blown instrument.

Bagpipe drone reeds have usually been produced by utilizing a hollow piece of cane tubing, sealed at one end and open at the opposing end. A "tongue" or elongated three-sided flap of cane is then cut from the body of the tube. This tongue vibrates and produces a tone as a result of airflow pushed around the tongue. The length of the tongue is altered by means of a "bridle" or loop of cord or other material which girdles the body of the reed and can be moved upward or downward as playing preference and pitch dictate, i.e., a longer tongue will produce a lower pitch and a shorter tongue will produce a higher pitch.

In the last 50 to 75 years, many other materials have been used instead of cane in an attempt to match the sound and performance of cane drone reeds in bagpipes. These materials have included injection-molded plastics, polymers, composites, and light alloy metals such as aluminum and brass, and have been used for both the body of the reed (the tube) and the tongue. However, problems have been experienced in terms of both performance (operation and dependability) and sound (pitch, intonation, and harmonic balance).

SUMMARY OF THE INVENTION

One particular design for providing a substitute to a cane reed, and forming the present invention, incorporates a wood based, polymer body (the tube), two thin plastic tongues, regulated by a short length of synthetic tubing (the bridle). A brass or plastic tube is screwed or pressed in one end to form the "seat" of the reed, or that portion which is pressed into the bagpipe itself. An opposite end of the tubular body includes a tuning pin to change a pitch of the reed.

Although the reed of the present invention can be manufactured successfully from a wide range of materials, the preferred embodiment would employ a wood, natural fibre polymer or phenolic tubular body; a light metal alloy, wood/natural fibre polymer or plastic/polymer reed seat and adjustable tuning pin; and two thin gauge plastic or polymer tongues made from pressed and polished PVC sheeting. The use of plastic avoids the need to find superior quality cane to make the reed.

The bagpipe reed is fashioned from a hollow tube as a body, threaded or tapered at both ends to provide for the use of a threaded or tapered plug (tuning pin) at either end, employed to adjust airflow and pitch. The tuning pin is a socket headed cap screw having external threads at one end and an enlarged, knurled head at the opposite end. The head includes a hexagonal shaped opening for rotation of the tuning pin into and out of the tubular body by an allen wrench.

The opposite end of the tubular body includes a threaded and tapered reed seat or moveable insertion base for the reed. The reed seat may be externally threaded at one end and include wrapped waxed threads in a tapered, conical configuration at the opposite end. The reed seat is moulded to include a plurality of ridges to assist in gripping waxed thread wrapped around the reed seat.

The length, diameter, and wall thickness of the main tube body are determined by the standard sizes and dimensions of various makes of bagpipes. A preferred wall thickness is 3/32 inch, with an inner diameter of 1/4 inch and an outer diameter of 7/16 inch.

The reed employs the use of two tongues, which vibrate to produce a tone that is amplified by the body of the reed. The tongues are attached at one end to two flat surfaces of the body, 180° apart from each other on opposite sides of the body. The ends are attached by a fixed bridle formed of wrapped waxed thread. The unattached or free ends of each of the tongues are positioned directly above a small air bleed orifice extending through the wall of the body at the opposed flat surfaces.

Air under pressure supplied by the piper, is allowed to pass through the two opposed air bleed orifices of the body and past the tongues and out the seat of the reed. A movable bridle surrounds the tubular body and the two tongues for tone adjustment. The proximity of the bridle to bends in the tongues determines the spacing of the free end of the tongues from the air bleed orifice. This controls the tone of the sound produced by the reed.

An advantageous effect is obtained by having a flat tongue lying adjacent a machined flat surface of the tubular body so as to extend beyond an edge of the air bleed orifice by approximately 0.5 mm. Air leakage, and therefore, sound are closely controlled.

Minimal moisture absorption ensures maintenance of relative positioning of the component parts. The preferred moisture absorption rates for the various components of the reed are as follows: the reed seat —1.5% or less; the tuning pin (or screw)—4%; the tongues—0.5% or less; and the body of the reed—1.5%. However, even with minimal moisture absorption, expansion of the reed seat and tuning pin in the reed body can wedge these parts in the respective ends of the body. Hexagonal shaped openings in the tuning pin and through the reed seat can be used to assist in twisting the tuning pin and the reed seat relative to the reed body with the assistance of an allen wrench.

The materials employed have low moisture absorption rates, are dimensionally stable, and are relatively unaffected by ambient temperature and humidity fluctuations. By virtue of the tapered or threaded portions at both ends of the tube body, a reed is made which is easily maintained and adjusted; is capable of being played with the tongues oriented in either of two positions (i.e., relatively up-facing, or relatively down-facing) to control tone and pitch; and is able to produce an extremely steady and reliable pitch and tone, as the airflow and pressure through two opposing tongues is equalized.

Accordingly, it is an object of the present invention to provide a synthetic bagpipe drone reed having a tubular body with at least one tongue positioned over an air bleed orifice and an adjustable tuning pin and a reed seat fitted in the ends of the tubular body and both the reed seat and the tuning pin being removable and shiftable to the respective opposite end of the tubular body so as to change the orientation of extension of the tongue mounted on the tubular body.

It is another object of the present invention to provide a synthetic bagpipe drone reed having a tubular body with two tongues positioned on opposite sides of the body over air bleed orifices and an adjustable tuning pin and a reed seat fitted in the ends of the tubular body and both the reed seat and the tuning pin being removable and shiftable to the respective opposite end of the tubular body so as to change the orientation of extension of the tongues mounted on the tubular body.

It is still another object of the present invention to provide a synthetic bagpipe drone reed having a tubular body with two tongues positioned on opposite sides of the body over air bleed orifices and an adjustable tuning pin and a reed seat fitted in the ends of the tubular body and both the reed seat and the tuning pin being removable and shiftable to the respective opposite end of the tubular body so as to change the orientation of extension of the tongues mounted on the tubular body and including a reed seat having a plurality of recesses for gripping thread wrapped around one end of the reed seat to assist in securing the thread to the reed seat.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
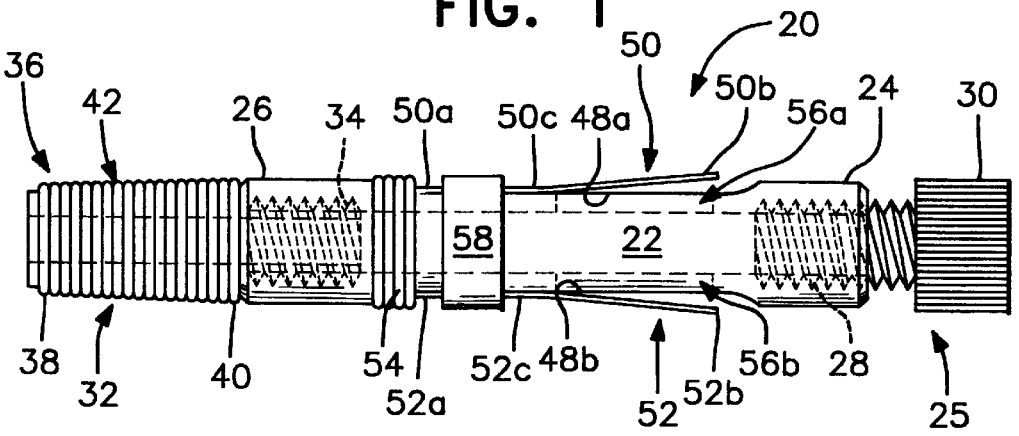
FIG. 1 is a side view of a synthetic bagpipe drone reed embodying the teachings of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
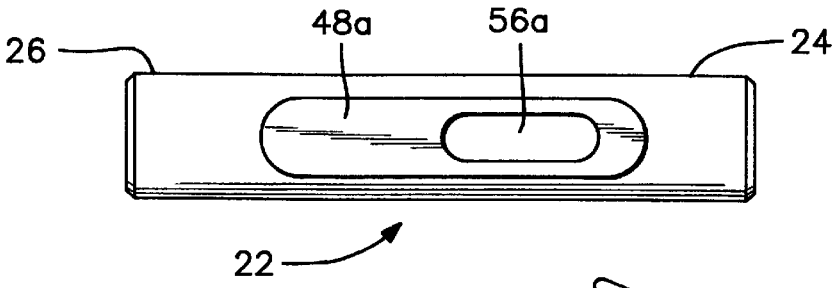
FIG. 2 is a plan view of a tubular body of the reed.

With reference to the drawings, in general, and to FIGS. 1 and 2, in particular, a synthetic bagpipe drone reed embodying the teachings of the subject invention is generally designated as 20. With reference to its orientation in FIG. 1, the synthetic bagpipe drone reed includes a tubular body 22 having opposite ends 24 and 26.

In FIG. 1, at end 24 is located a socket headed cap screw referred to as a reed tuning pin 25. The tuning pin 25 includes a threaded end 28 and a knurled head 30 at an opposite end. The head 30 includes a hexagonal recess 31 for enagement by the head of an allen wrench for rotation of the tuning pin in the event that the tuning pin becomes fixed in the end 24 of the tubular body 22.

Rotation of the head 30 moves the tuning pin 25 into and out of the tubular body 20. The tuning pin is threadably mounted in end 24 of tubular body 20 so as to vary the pitch of the bagpipe reed.

End 24 is internally threaded so as to matingly receive the external threads located at end 28 of the tuning pin 26. The threaded end 28 of the tuning pin is solid so as to block the passage of air from escaping from end 24 of the tubular body 22.

At the opposite end 26 of the tubular body 22 is reed seat 32. One end 34 of reed seat 32 is externally threaded to engage with the internal threads of the end 26 of the tubular body 22. The opposite end 36 of the reed seat is tapered at an angle so that the diameter of end 36 at point 38 is approximately 7 millimeters, tapering inwardly from point 40 having a diameter of approximately 9 millimeters. These diameters include a layer of wrapped thread 42 which extends around the reed seat for providing a frictional fit with a bagpipe drone as well be explained in more detail later.

Figure 11:
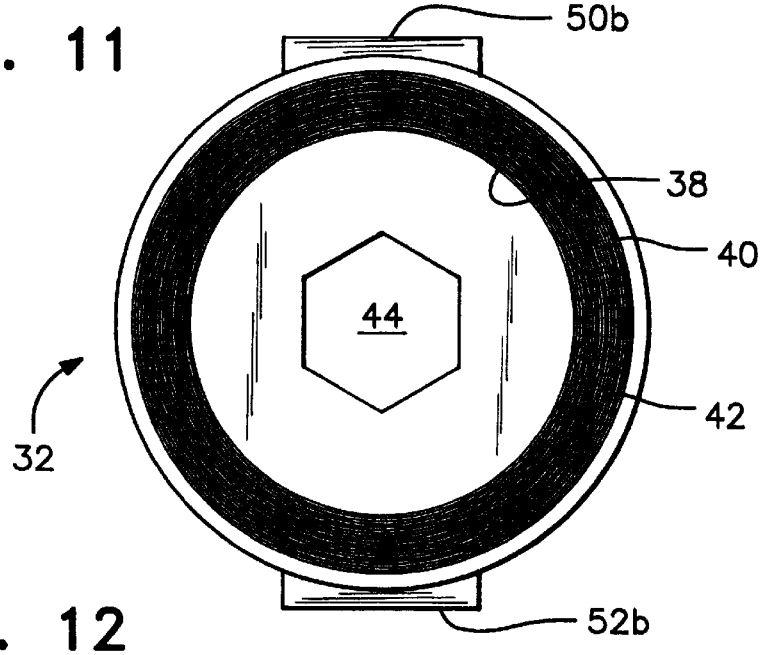
FIG. 11 is an enlarged end view taken from the left side of the reed shown in FIG. 1 to illustrate the shape of the through bore in the seat of the reed for facilitating turning of the seat by an allen wrench to rotate the seat.
Figure 12:
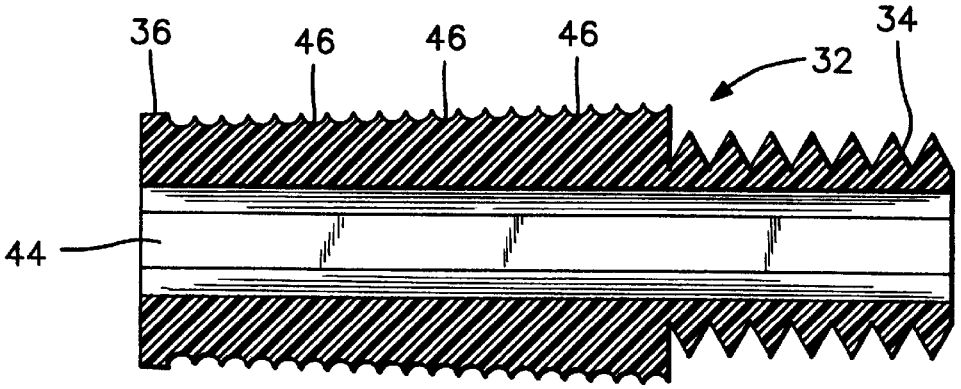
FIG. 12 is an enlarged cross sectional view of the seat of the reed without wrapped waxed thread and illustrating the moulded undulating or groove pattern in the surface of one end of the seat to help retain the thread as the thread is wrapped around the one end of the seat.

With reference to FIGS. 11 and 12, the reed seat includes a hexagonally shaped passageway 44 extending through the reed seat. The shape of the passageway 44 aids in the unscrewing of the reed seat from end 26 of tubular body 22 in the event of expansion of the reed seat.

End 36 of the reed seat includes a plurality of recesses or grooves 46 as shown in FIG. 12. These grooves facilitate the gripping of waxed threads 42 as the threads are wrapped around the tapered end 36 of the reed seat.

The tubular body 22 includes two recessed flat surfaces 48*a*, 48*b*. These surfaces provide a flattened surface for the anchoring of one end 50*a*, 52*a*, of tongues 50, 52. The two tongues are mounted on opposite sides of the tubular body 22 and are secured in the flat surfaces 48*a*, 48*b* by waxed thread 54 which surrounds the tubular body 22. The two tongues 50, 52 are positioned so that their free ends 50*b*, 52*b* extend over air bleed holes 56*a*, 56*b* located on opposite sides of the tubular body and extending through the flat surfaces 48*a*, 48*b*.

The separation distance between the free ends 50*b*, 52*b* from the flat surfaces 48*a*, 48*b* is dependent upon the angle of bend at central portion 50*c*, 52*c* of the tongues 50, 52. An angle of bend is typically in the range of 15 to 20 degrees. However, the amount of separation of the free ends 50*b*, 52*b* from the flat surface 48*a*, 48*b* is also controlled by a slidable bridle 58 which surrounds the tubular body 22 and the two tongues 50, 52. The closer the bridle 58 is moved to the bends 50*c*, 52*c*, the closer the free ends 50*b*, 52*b* will be to the flat surfaces 48*a*, 48*b* so as to vary the pitch and tone of air that enters through the air bleed orifices 56*a*, 56*b* and exits through the reed seat at end 26 of tubular body 22.

Figure 3:
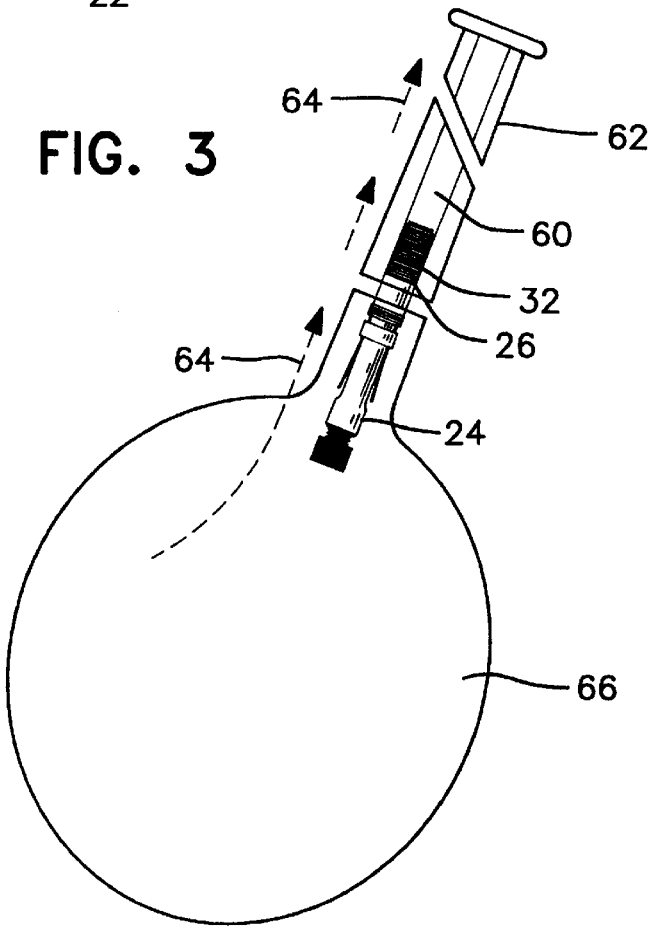
FIG. 3 is a schematic drawing of the reed of the present invention located between a bagpipe drone and a bag so as to vary the sound produced by the bagpipe.

As shown in FIG. 3, when the bagpipe reed 20 of the present invention is wedged into a passageway 60 of bagpipe drone 62 by the reed seat 32, air is moved in a direction of arrows 64 from a bag 66. The air passes down into the tubular body 22 through the orifices 56*a*, 56*b* and through the passageway defined by the tubular body, communicating with the passageway 44 of the reed seat.

Figure 4:
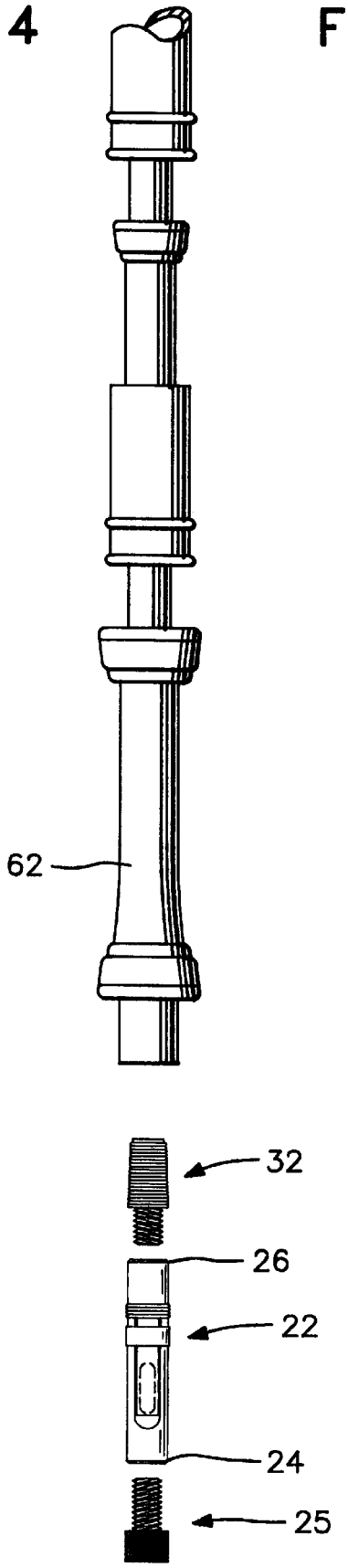
FIGS. 4 and 5 are exploded views of the synthetic bagpipe drone reed of the present invention, located adjacent to a bagpipe drone. The two views show the alternative placement of the tubular body of the reed, with the tongues pointing down in FIG. 4 and the tongues pointing up in FIG. 5.
Figure 6:
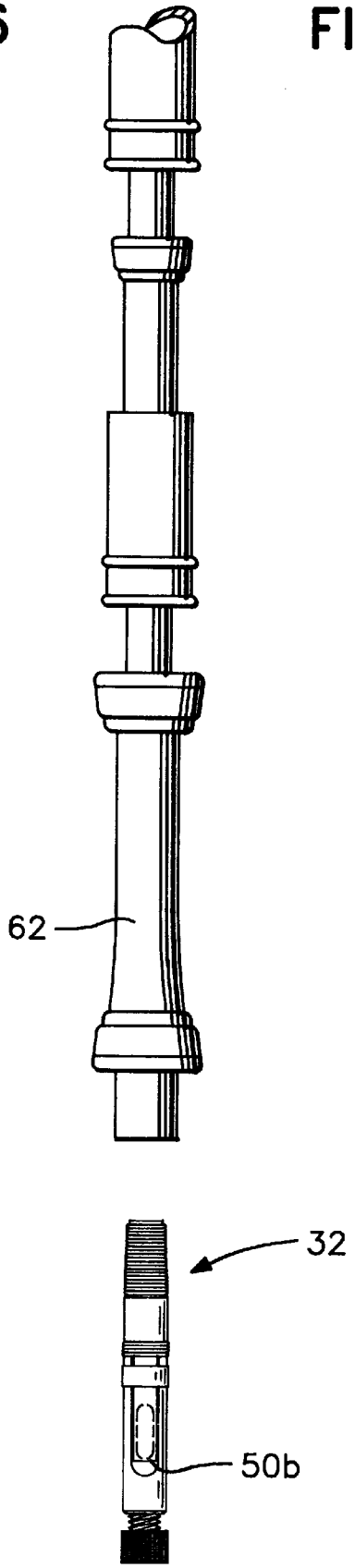
FIGS. 6 and 7 show the assembled synthetic bagpipe drone reeds of FIGS. 4 and 5, respectively, located adjacent to the bagpipe drone.
Figure 8:
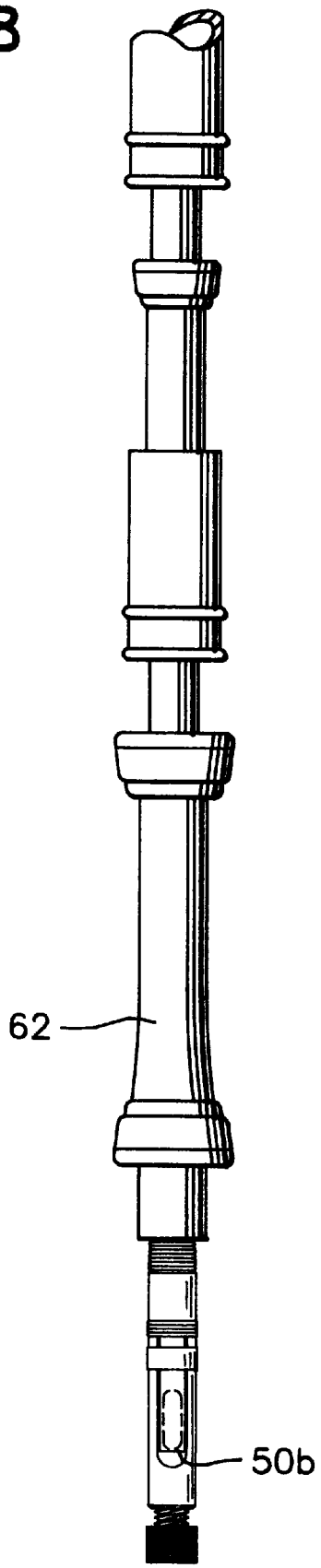
FIGS. 8 and 9 show the assembled synthetic bagpipe drone reeds of FIGS. 4 and 5, respectively, inserted into a bagpipe drone with the tapered seat engaging in an open end of the bagpipe drone.

In practice, as shown in FIGS. 4, 6 and 8, the reed seat is secured in end 25 of tubular body 22 and the tuning pin 26 is secured in end 24 of tubular body 22. As assembled in FIG. 6 and as inserted in bagpipe drone 62 in FIG. 8, the free ends 50*b*, 52*b* of the tongues 50, 52 point in a direction away from the reed seat 32. However, because the reed seat 32 and tuning pin 25 are removably mounted on the tubular body 22, and the threaded openings at end 24, 26 of the tubular body are of the same dimensions, the reed seat 32 and tuning pin 25 may be removed from the tubular body and reattached to the tubular body at the opposite ends 24, 26, respectively, of the tubular body 22.

Figure 5:
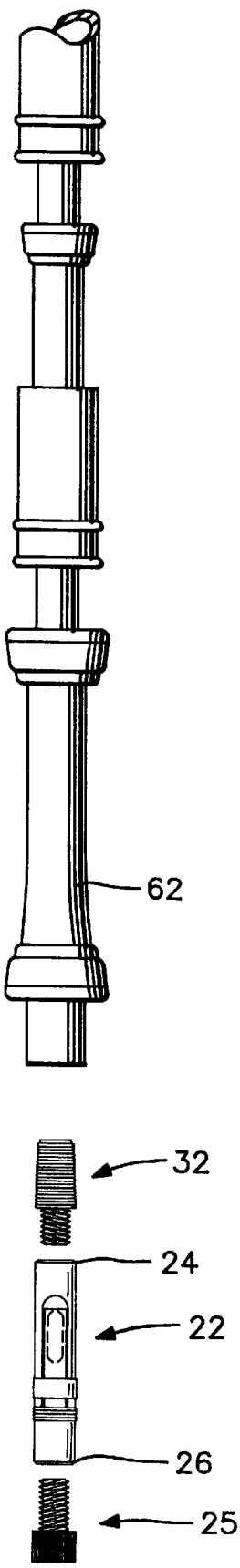
Figure 7:
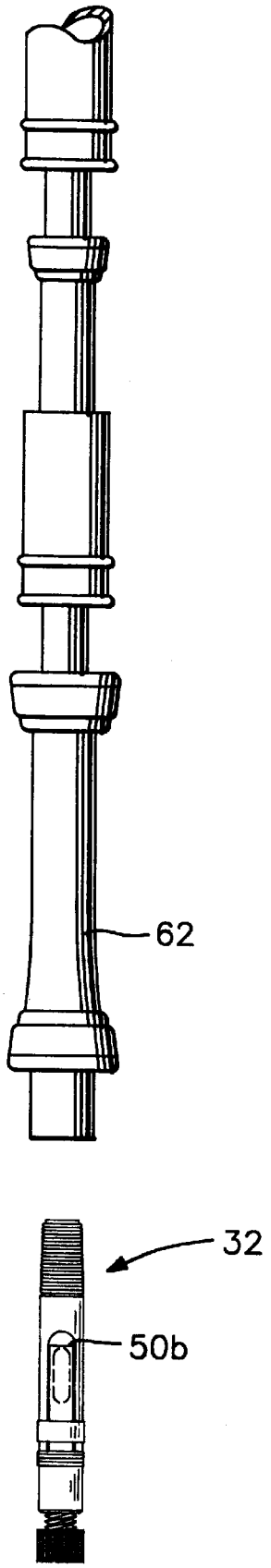
Figure 9:
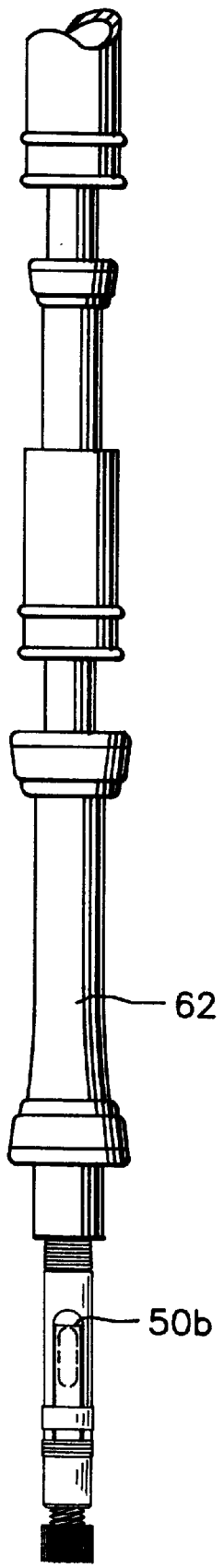
Figure 10:
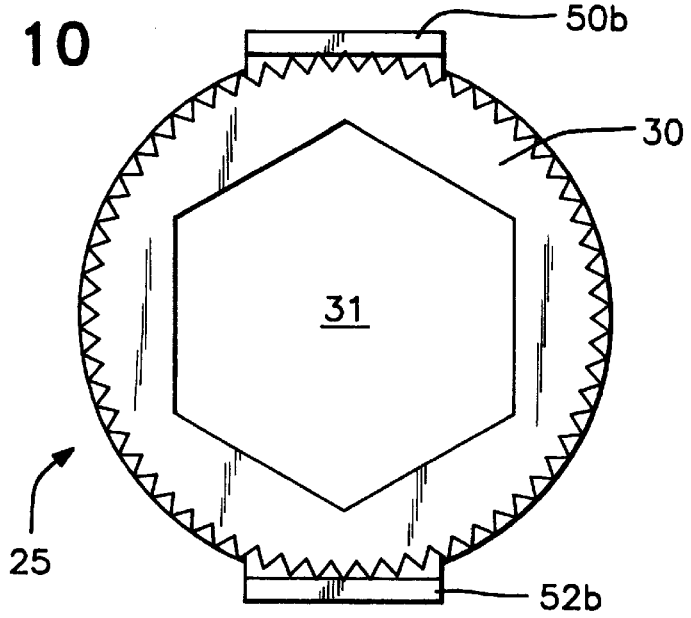
FIG. 10 is an enlarged end view taken from the right side of the reed shown in FIG. 1 to illustrate the recessed opening in the head of the tuning pin for receipt of an allen wrench to rotate the tuning pin.

Therefore, as shown in FIGS. 5, 7 and 9 and particularly in the assembled condition shown in FIG. 7, the free ends 50*b*, 52*b* of the tongues 50, 52 would point in the opposite direction from that shown in FIGS. 4, 6 and 8 so that the free ends 50*b*, 52*b* of the tongues 50, 52 extend towards the reed seat 32. As assembled and secured in bagpipe drone 62, as shown in FIG. 9, the tongues 50, 52 are oriented 180 degrees with respect to the position shown in FIG. 8.

By reversing the direction or orientation of the tongues by the removal of the reed seat 32 and tuning pin 25 and reattachment of these pieces at opposite ends of the tubular body 22, the tone and pitch produced by the bagpipe reed can be improved, particularly when used in combination with old drones. A slightly sharper and more muted sound will be produced which can compensate for the aging of the drone.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A bagpipe reed comprising:

a tubular body having two ends, a tuning pin adjustably mounted in one of said two ends of said body, and a reed seat mounted in the other of said two ends of said tubular body, said tuning pin and said reed seat being removably mounted in either one of said two ends of said tubular body to orient said tubular body in one of two different directions when mounted in a bagpipe.

2. A bagpipe reed as claimed in claim 1, wherein said tubular body includes two air bleed orifices.

3. A bagpipe reed as claimed in claim 2, wherein two tongues are pivotally mounted on said tubular body and each of said two tongues extends over a respective one of said two air bleed orifices.

4. A bagpipe reed as claimed in claim 1, wherein said tuning pin is threaded at one end and includes a turning head at an opposite end.

5. A bagpipe reed as claimed in claim 4, wherein said turning head includes a recess for receipt of a tool to assist in turning said turning head with respect to said tubular body.

6. A bagpipe reed as claimed in claim 1, wherein said reed is threaded at one end and tapered at an opposite end for frictional engagement in a bagpipe drone.

7. A bagpipe reed as claimed in claim 6, wherein said opposite end includes wrapped thread.

8. A bagpipe reed as claimed in claim 7, wherein said opposite end includes a plurality of recesses for gripping said wrapped thread and assisting in securing said wrapped thread around said opposite, tapered end.

9. A bagpipe reed as claimed in claim 6, wherein said reed seat includes a hexagonal shaped passageway for receipt of a tool to assist in turning said reed seat with respect to said tubular body.

10. A bagpipe reed as claimed in claim 1, wherein said tubular body, said tuning pin and said reed seat are made of synthetic materials.

11. A bagpipe reed as claimed in claim 3, wherein said tubular body, said tuning pin, said reed seat and said two tongues are made of synthetic materials.

12. A bagpipe reed comprising:

a tubular body having two threaded ends and two air bleed orifices, a tuning pin threadably mounted in one of said two ends of said tubular body, a reed seat threadably mounted in the other of said two ends of said tubular body, two tongues pivotably mounted on said tubular body, each of said two tongues extending over a respective one of said two air bleed orifices, said tuning pin and said reed seat being removably mounted in either one of said two ends of said tubular body so as to orient said two tongues in one of two different directions when mounted in a bagpipe.

13. A bagpipe reed as claimed in claim 12, wherein said reed is threaded at one end and tapered at an opposite end for frictional engagement in a bagpipe drone.

14. A bagpipe reed as claimed in claim 13, wherein said opposite end includes wrapped thread.

15. A bagpipe reed as claimed in claim 14, wherein said opposite end includes a plurality of recesses for gripping said wrapped thread and assisting in securing said wrapped tread around said opposite, tapered end.

16. A bagpipe reed as claimed in claim 13, wherein said reed seat includes a hexagonal shaped passageway for receipt of a tool to assist in turning said reed seat with respect to said tubular body.

17. A bagpipe reed as claimed in claim 12, wherein said tubular body, said tuning pin and said reed seat are made of synthetic materials.

18. A bagpipe reed as claimed in claim 12, wherein said tubular body, said tuning pin, said reed seat and said two tongues are made of synthetic materials.

19. A bagpipe reed comprising:

a tubular body having two ends and two air bleed orifices, two tongues pivotally mounted on said tubular body, each of said two tongues extending over a respective one of said two air bleed orifices, said tubular body and said two tongues being made of synthetic materials.

20. A bagpipe reed as claimed in claim 19, wherein said tubular body is mountable in a bagpipe in one of two different orientations.

* * * * *